United States Patent [19]

Hatz

[11] 4,077,383

[45] Mar. 7, 1978

[54] INTERNAL COMBUSTION ENGINE WITH SOUND DEADENING JACKETING

[75] Inventor: Ernst Hatz, Ruhstorf, Germany

[73] Assignee: Motorenfabrik Hatz GmbH & Co. KG, Ruhstorf, Germany

[21] Appl. No.: 638,169

[22] Filed: Dec. 5, 1975

[30] Foreign Application Priority Data

Dec. 11, 1974 Germany ..... 2458629

[51] Int. Cl.[2] ..... F02B 77/00; F02F 7/00

[52] U.S. Cl. ..... 123/198 E; 123/195 C; 181/200

[58] Field of Search ..... 123/41.33, 41.65, 41.7, 123/195 C, 198 E; 181/33 K, 200, 205

[56] References Cited

U.S. PATENT DOCUMENTS

| | | | |
|---|---|---|---|
| 3,090,463 | 5/1963 | Yanda | 123/195 C |
| 3,147,814 | 9/1964 | Suhre | 123/41.65 |
| 3,164,140 | 1/1965 | Nuttall | 123/41.65 |
| 3,412,724 | 11/1968 | Scheiterlein | 181/33 K |
| 3,540,425 | 11/1970 | Scheiterlein | 181/33 K |
| 3,684,053 | 8/1972 | Fachbach | 123/198 E |
| 3,782,496 | 1/1974 | Thien | 181/33 K |
| 3,924,597 | 12/1975 | Hatz | 123/195 C |

FOREIGN PATENT DOCUMENTS

| | | | |
|---|---|---|---|
| 1,251,634 | 12/1960 | France | 123/195 C |
| 30,206 | 7/1964 | Germany | 123/41.7 |
| 706,327 | 3/1954 | United Kingdom | 123/41.33 |
| 1,166,140 | 10/1969 | United Kingdom | 123/198 E |

*Primary Examiner*—Charles J. Myhre
*Assistant Examiner*—William Randolph
*Attorney, Agent, or Firm*—Blanchard, Flynn, Thiel, Boutell & Tanis

[57] ABSTRACT

An internal combustion engine having the cylinders thereof arranged in a V-formation and having a sound deadening material jacketing the body of the engine. Two plate-like carriers are gripped between the confronting parts of the cylinder housing and the outwardly projecting rims thereof to constitute a frame which surrounds the engine body from all sides. A plurality of deadening shells conforming to the shape of the engine body bear in sealed fashion against the frame with the interposition of at least one vibration deadening insert. These shells are secured to the body of the engine with the intermediary of spacer elements providing a vibration dampening support.

8 Claims, 7 Drawing Figures

INTERNAL COMBUSTION ENGINE WITH SOUND DEADENING JACKETING

FIELD OF THE INVENTION

This invention relates to an internal combustion engine with cylinders arranged in a V configuration and a sound deadening jacketing of the engine body.

BACKGROUND OF THE INVENTION

It is an object of the present invention to provide a jacketing structure which is advantageous for engines of this kind and at the same time is compact, which can be produced and mounted in an economically viable fashion, which does not in any way obstruct the servicing of the engine, and finally ensures an optimum degree of muffling. These objects are achieved in accordance with the present invention by the fact that two carriers of plate form are gripped between the confronting parts of a cylinder housing and the outwardly projecting rims of said carriers constitute a frame which surrounds the engine body from all sides, a plurality of deadening shells conforming to the shape of the engine body bearing in sealed fashion against the same frame with the interposition of at least one vibration deadening insert, and these shells being secured to the body of the engine with the intermediary of spacer elements providing a vibration dampening support.

In the case of internal combustion engines with rows of cylinders arranged in V-formation and a blower which sends cooling air into the gap between the machine body and the jacketing, an advantageous arrangement is achieved by the fact that the sound deadening shell is arranged at each longitudinal side of the rows of cylinders in such a way that the free ends thereof extend to the lower zone of the crank case and defines with the side walls thereof an outlet slot for the cooling air.

A further advantageous form of the invention is achieved by the fact that all free standing outer walls of the crankcase are provided with at least a layer of sound deadening material directly applied thereto, and the two deadening shells arranged along the cylinder rows are equipped at their inner walls with a layer of sound deadening material. By this means a very long sound deadening trajectory or path is defined between the crankcase and the deadening shells, this trajectory reaching to the outlet slot and assisting in the high amount of reduction of the vibrations and noise at the outlet end of the cooling air conduction system of the engine. The deadening layer at the outer walls of the crankcase thus fulfills a second function, namely to reduce the radiation of body noise from these walls.

Another advantageous feature of the invention lies in the fact that the blower is arranged at a narrow side of the engine and the driving shaft of the blower wheel is mounted at the uppermost part in the gap between the V-form cylinder rows, the deadening shell at this side being provided with two inlet ports for cooling air. By this arrangement the cooling air is always inducted at the highest part of the engine so that scarcely any heavy polluted air can be drawn into the system.

It is advantageous in accordance with another feature of the invention that the two inlet ports are provided at their inner walls in each case with a layer of sound deadening material. An optimal effective long deadening run, with a deflection through 90°, is provided for in this way at the inlet side of the cooling air conduction system, without calling for any additional installation space.

In engines of the type which have concavity in the crank case for accommodating an externally mounted additional appliance, for example a starter, in an advantageous arrangement the concavity is closed by a cover which is provided with a layer of sound deadening material at its outer wall. By this means the deadening trajectory at the exhaust side of the cooling air conduction system is not retracted in any way by the concavity and therefore does not detrimentally affect the degree of muffling. Moreover, it reduces the radiation of sound from the starter itself.

A further feature of the invention provides that the air filter and the oil cooler are arranged inside the cover at the topmost part of the engine and are exposed directly to the air stream from the blower. Scarcely any grossly polluted air can then be passed to the air filter, and the oil cooler will therefore invariably receive compartively cool air.

BRIEF DESCRIPTION OF THE DRAWINGS

An embodiment of the invention will now be described with reference to the accompanying drawings, in which.

DETAILED DESCRIPTION

Figure 1:
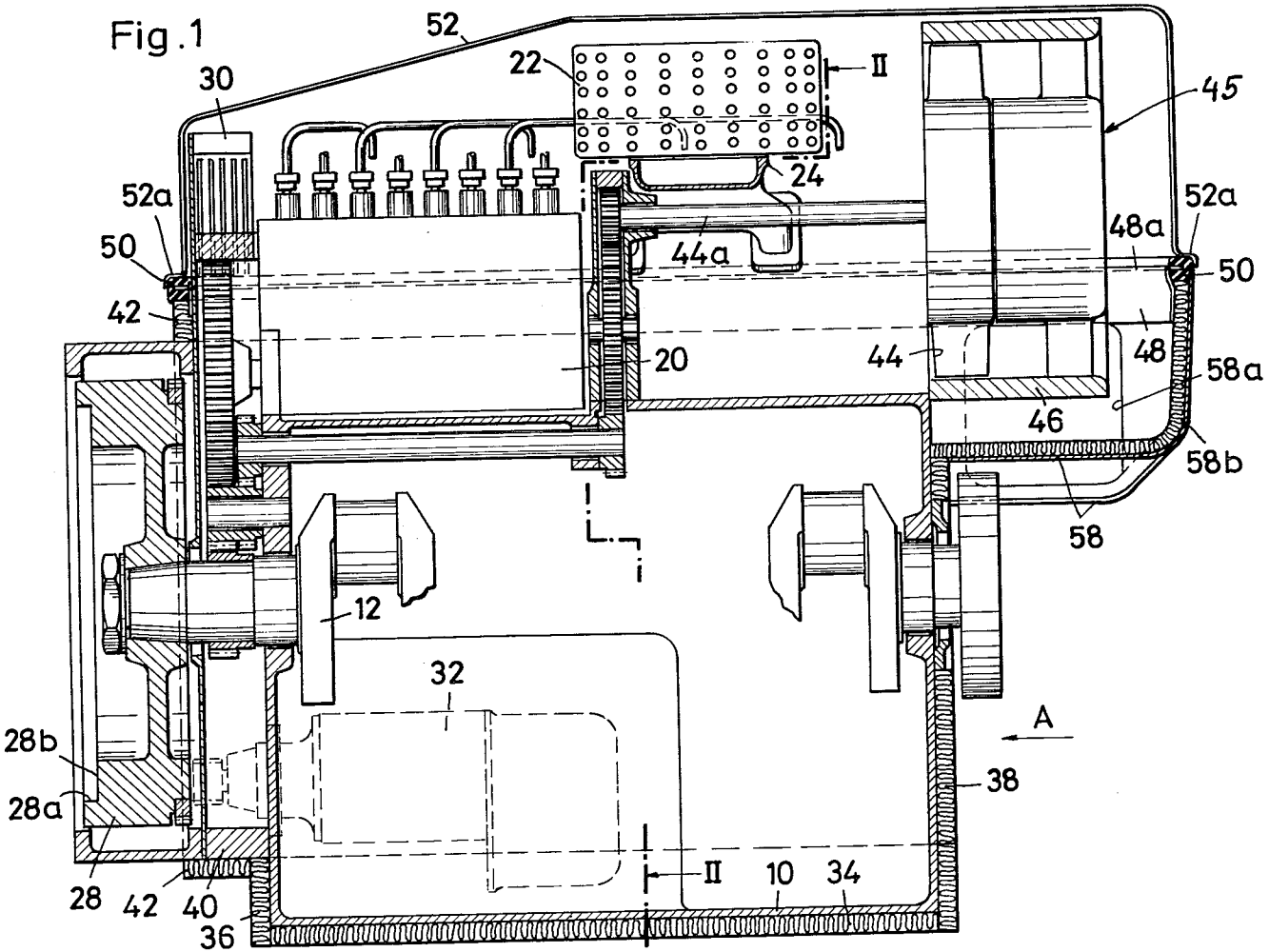
FIG. 1 is a longitudinal section through the internal combustion engine.

The internal combustion engine which is illustrated in the drawings is an air cooled injection engine having eight cylinders inclined to the vertical and arranged in a conventional V-8 configuration. Th engine comprises a crankcase 10 having a crankshaft 12 rotatably mounted therein, the individual cylinders 14 with cylinder heads 16 and control gear covers 18 being connected to the crankcase 10 in a conventional manner. The fuel feed from a tank (not shown) is effected by an injection pump 20 driven by the crankshaft 12 and this pump 20 supplies fuel to the injection nozzle of each individual cylinder through a compression conduit. Combustion air is supplied through an air filter 22 which is connected to the inlet ports of the cylinders 14 through two pipes 24. Combustion gases are evacuated through two exhaust pipes 26.

A flywheel 28 is secured to one end of the crankshaft 12 and has fixing surfaces **28*a* and 28*b*** for coupling means (not shown) used, in association with fastening screws (also not shown), for coupling the internal combustion engine to the plant which is to be driven.

Two oil coolers 30 are provided, one being associated with each bank or row of cylinders. In addition, en electric starter 32 is arranged externally in a concavity of the crankcase. These parts are of a known form and effect and, therefore, need not be further described.

The following arrangement has been developed for quieting the noise in this V-type engine caused by vibration of the parts.

The free external surfaces of the crankcase 10 have applied thereto, for example by cementing, sound deadening layers 34, 36, 38 conforming to the shape of these surfaces. An extension 40 of dished form connected to crankcase 10 to form an extension of the latter and enclosing the control gearing is also provided with a sound deadening layer 42.

The engine has a cooling air blower 45 of known type and this is arranged at the top between the two rows of cylinders. The shaft 44*a* of the rotor blower wheel 4 is driven from the crankshaft 12 through gearing in the manner illustrated. The casing 46 of the blower 45 is fastened to the crankcase 10 by means not illustrated, for example as by a flange and bolts securing the flange to the casing 10.

Figure 2:
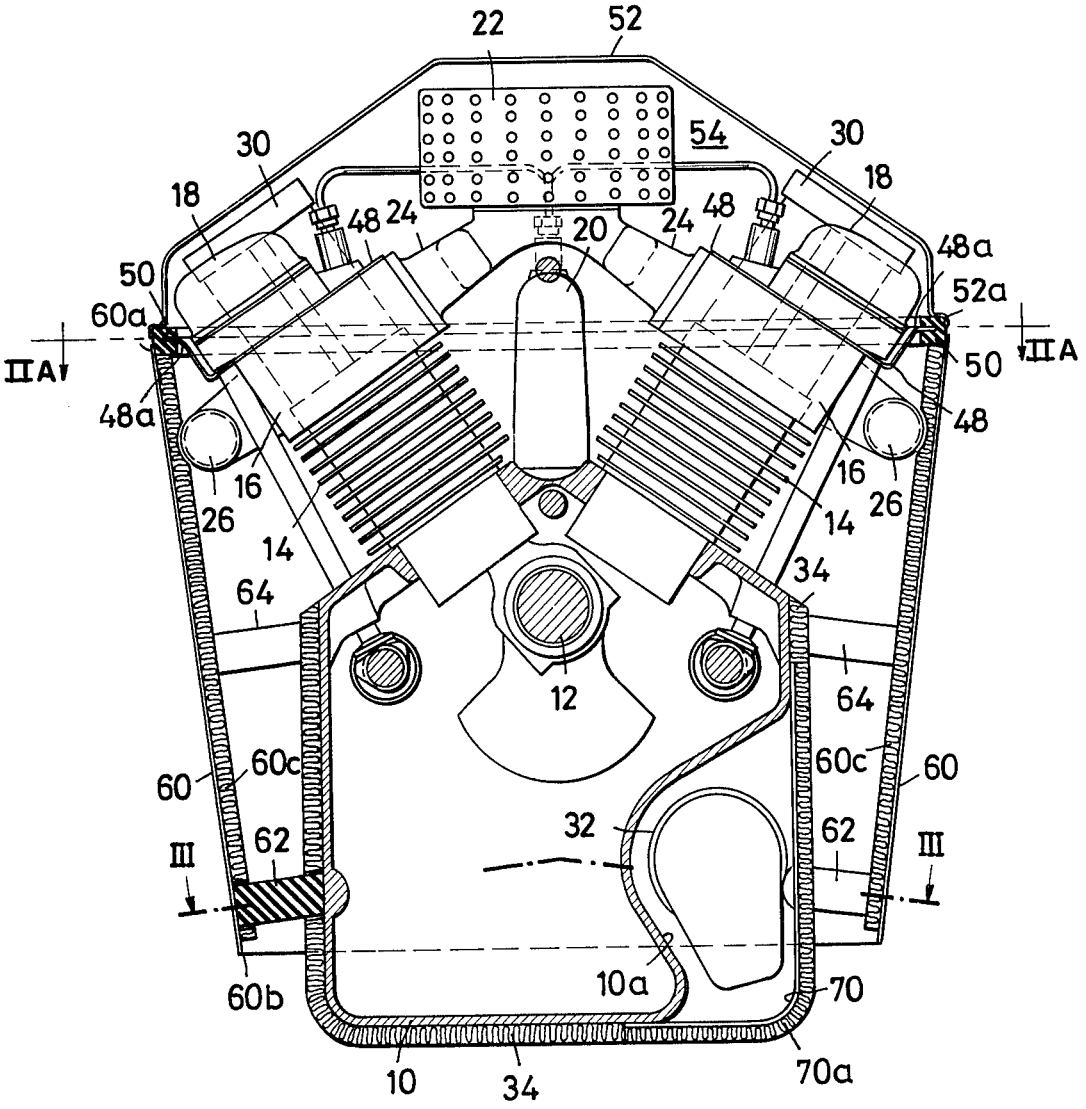
FIG. 2 is a vertical cross section taken along the line II—II in FIG. 1.
Figure 2A:
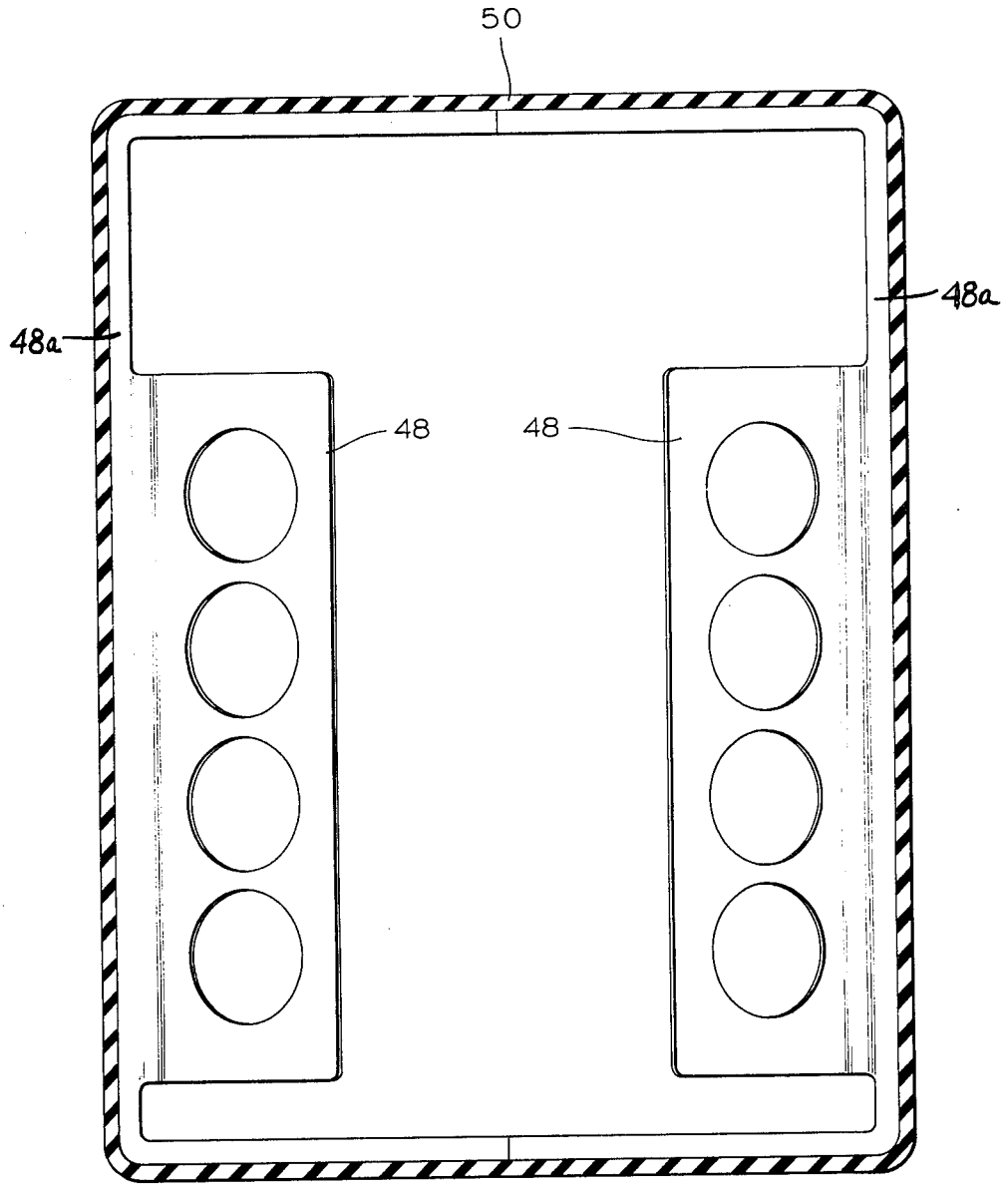
FIG. 2A is a partially schematicized sectional view of only the platelike carriers and associated seal taken along the line IIA—IIA in FIG. 2.

Moreover, two plate-like carriers 48 are provided, each one of which is secured between the cylinder head 16 and the cover 18 of the four cylinders of a V-row by the same means which are used to fasten the elements 18, 16, 14. Each carrier 48 has openings in the surface thereof for free passage of the various functioning parts. Outwardly directed rims 48*a* of the parts 48 are generally horizontally aligned (FIGS. 2 and 6) to encircle the body of the engine from all sides to define a frame, the rim parts being, for example, welded or soldered together. The rim, which is rectangular in shape externally has a fixed position in space, and thus also in relation to the various elements of the engine, because of the connection between the carriers 48 and the body of the engine. A sealing rib 50 of rubber or the like is pushed on to the outer rim 48*a*.

A cover sheet 52 is provided to cover all engine parts from above. The rectangular rim 52*a* thereof is secured to the sealing rib 50. The anchorage of the sealing rib 50 and cover sheet 52 to the engine body is explained below. In any event, the cover sheet 52 is readily releasable from the engine body.

Figure 4:
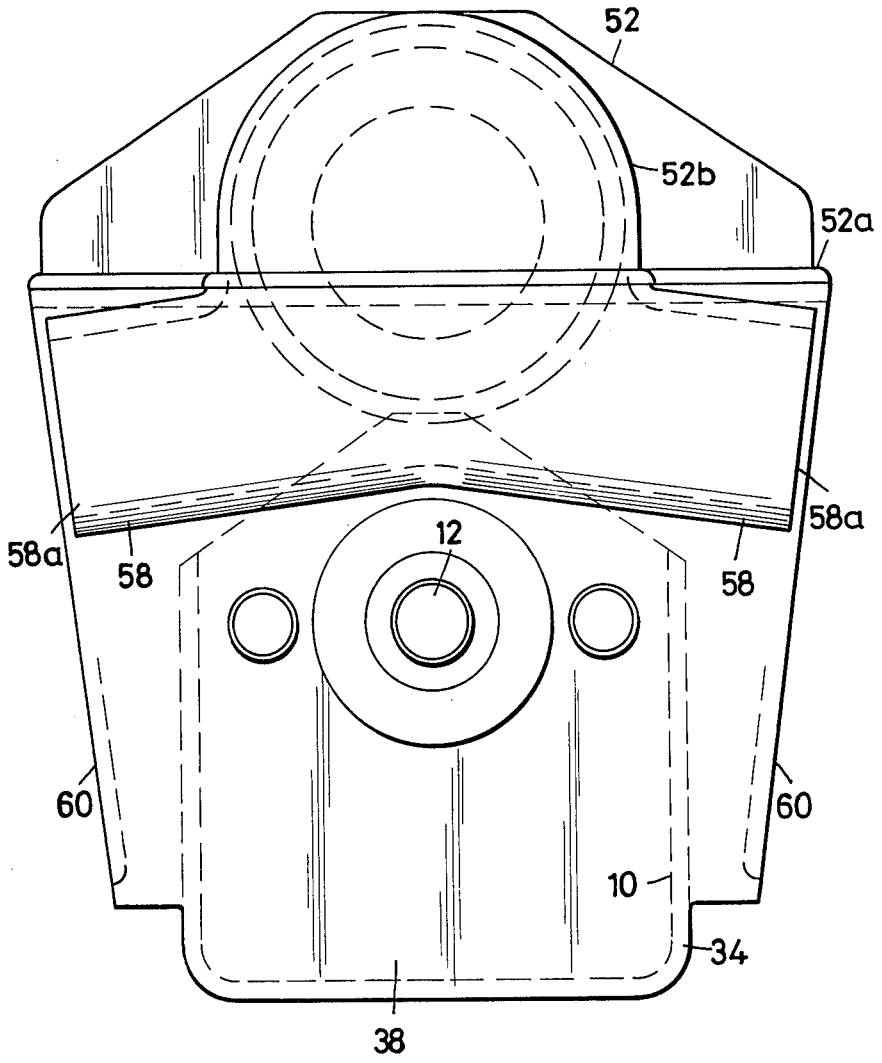
FIG. 4 is a side elevation seen in the direction of arrow A in FIG. 1.

The zone 52*b* (FIG. 4) of the cover sheet 52 enclosing the blower casing 46 is formed and shaped so as to be spaced closely to the periphery of the blower casing 46. The blower casing 46 is enclosed from below by the sheet part 58 having a deadening layer 58*b* thereon, this sheet being formed with two channels approximately tangential to the blower casing and having inlet ports 58*a* for the cooling and combustion air. The connection between the deadening shell 58, the sealing rib 50 and the crankcase 10 or the deadening layer 38 is preferably effected by adhesive means.

Spaced at a specific distance along each side of the crankcase 10 is an elongated deadening shell 60. A number of spacer elements 62,64 of rubber or the like are used to anchor the deadening shell to the crankcase 10. Preferably the elements 62,64 are cemented to the parts 60 and 10. The upper edge 60*a* of these shells 60 engage the sealing rib 50 and are thereby orientated in relation to the engine body. The lower edge of each shell 60 defines, with the outside of the crankcase 10, an open gap 60*b* thus providing two outwardly directed outlet slots for exhaust air. The cooling air which is drawn in by the blower 45 through the inlet ports 58*a* is directed against the cylinders of the two rows, flows over the hot outer parts thereof, and exits through the outlet slots 60*b* to the exterior.

The air filter 22 for the combustion air and the two oil coolers 30 are also arranged at the uppermost part of the engine approximately opposite the blower 45 and thereby exposed to the still relatively cool air flow from blower ports 44,46. The starter 32 is enclosed in the cavity 10*a* by means of a cover 70 which is connected in readily detachable fashion with the crankcase 10 (by means not shown). Cemented to the outer side of cover 70 is a deadening layer 70*a* which supplements the deadening layers of the crankcase 10. The two shells 60 are also provided internally with a deadening layer 60*c*. Thus, in this way there are very long sound deadening passages (that is to say, conduits equipped with sound deadening layers) both at the inlet and the outlet side of the cooling air blower. This produces a very high degree of sound muffling of all the noise which is produced in the engine. The jacketing of the crankcase 10 by sound deadening layers and the closure of the upper part of the machine by the cover sheet 52 together ensure that the noise radiated from the engine body itself is effectively muffled, even in the case of an internal combustion engine with a V-cylinder arrangement. Thus, parts of the deadening shells covering parts of the engine which require servicing are at the same time so devised that they can be readily dismounted for servicing purposes. The rim 48*a* of carrier 48 which is stationary, forms a base and carries the sealing means, further facilitates a replacement of the removed shells without difficulty in the correct position after the repair work or the like has been carried out.

Figure 5:
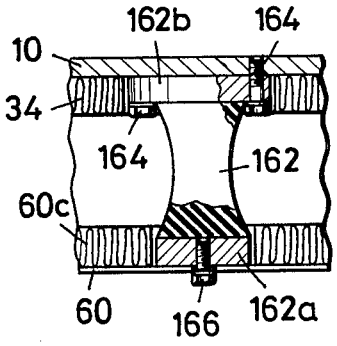
FIGS. 5 and 6 show details in section and on an enlarged scale.

When the shells 60 are detached, the spacer elements 62, 64 must be released from the engine body or from the wall 10 and re-cemented after repair or servicing of the engine. FIG. 5 shows that buffer elements, known per se, can be used for detachable anchorage of the shells 60. Such elements 162 made of rubber or the like are firmly connected to two metallic plates 162*a* and 162*b*, for example being vulcanized thereto. The buffer elements 162 are connected firmly to wall 10 by means of screws 164, while a screw 166 is used for detachable connection of the deadening shell 60,60*c* to the buffer 162.

Figure 6:
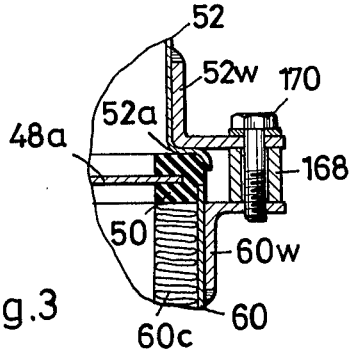
Figure 3:
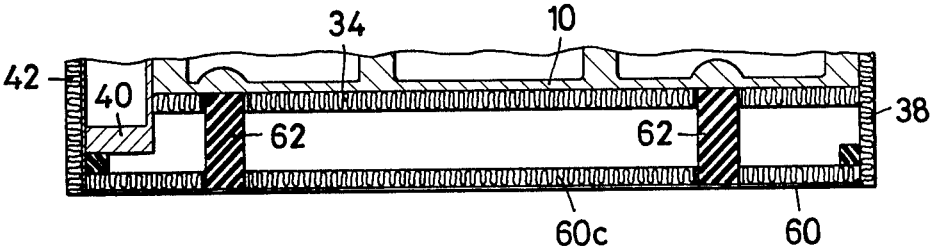
FIG. 3 is a partial horizontal section taken along the line III—III of FIG. 2.

Again, each cover plate could, for example, be connected in readily detachable fashion to the rim 48*a* through the agency of a manually operable closure flap. Another form of readily detachable construction is shown in FIG. 6. In this case, a number of spaced angle pieces 52*w* are secured to sheet 52, for example being welded to it. A number of angle pieces 60*w* are also welded to sheet 60. A very readily detachable anchorage of the cover sheet 52 to the engine is then achieved through the agency of screws 170 and spacer sleeves 168.

The exhaust pipes 26 may — depending on specific requirements or differing engine constructions — be guided directly to the exterior through the cemented deadening jacketing 42, or an arrangement can be so devised that the exhaust pipes 26 are directed towards the outlet slots 60*b* so that the combustion gases together with the hot cooling air stream can escape through these outlet slots.

Each of the deadening layers referred to above may, for example, consist of one or more layers of rock wool which are held together internally or externally with a thin foraminated covering of woven fabric or the like. The deadening layer is preferably secured to the associated surface by cementing through the agency of a heat resistant adhesive. Deadening layers of this nature are known per se and need not therefore be set out or illustrated in more detail at this juncture.

Finally, it is to be noted that the noise deadening jacketing of the machine only projects to an insignificant extent beyond the periphery of the engine and consequently does not call for any appreciable increase in the installation space for the jacketed engine.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An internal combustion engine having an engine body and a cylinder housing, at least two cylinders in said cylinder housing, said cylinder housing being arranged in a V-formation, each half of the V-formation having at least two mating parts fastened together, comprising:

two separate support plates, each thereof being inclined to the vertical in opposed directions and clamped between said two mating parts of each half of said V-formed cylinder housing, each support plate having outwardly projecting coplanar rim means thereon defining a closed and planar frame which encircles both halves of said cylinder housing, the planes of each of said support plates being inclined to the plane of said frame;

sound deadening means completely jacketing the body of the engine and said cylinder housing, said sound deadening means comprising a plurality of sound deadening shells conforming to the shape of the engine body and covering the totality of said cylinder housing, at least one vibration deadening insert mounted on said frame;

releasable securement means for releasably securing each of said shells to each of said support plates, each shell bearing in sealed fashion to said vibration deadening insert on said frame; and a spacer element inserted between said engine body and at least one of said shells, each spacer element providing a vibration dampening support holding said one of said shells at a fixed and spaced distance from said engine body.

2. An internal combustion engine according to claim 1, wherein said engine body has rows of cylinders arranged in a V-configuration and a crankcase and a cooling air blower, wherein at least one of the sound deadening shells is secured to said frame and is arranged along a longitudinal side of the rows of cylinders so that a free end part thereof extends to the lower zone of the crankcase, said spacer element holding said free end part a defined distance from the side wall of the crankcase forming thereby an outlet slot for the cooling air stream from said blower.

3. An internal combustion engine according to claim 2, wherein all free standing outer walls of the crankcase are provided with at least one layer of sound deadening material directly applied thereto, and wherein said at least one sound deadening shell which is arranged along a cylinder row has on the inner wall thereof a layer of sound deadening material.

4. An internal combustion engine according to claim 2, wherein said blower has a blower wheel thereon and is arranged at one end of the engine, a driving shaft of the blower wheel is mounted at the uppermost part of the gap between the V-form cylinder rows, one sound deadening shell secured to said frame being fitted to said one end of said engine and has two inlet ports for cooling air.

5. An internal combustion engine according to claim 4, wherein the inner walls of said two inlet ports are each lined with a layer of sound deadening material.

6. An internal combustion engine according to claim 4, including an air filter and an oil cooler, said air filter and said cooler being arranged inside the shells at the topmost part of the engine and are exposed directly to the air stream from said blower.

7. An internal combustion engine according to claim 1, wherein said engine body includes a crankcase, and wherein the crankcase is provided with a concavity in which an external auxiliary appliance is installed, and wherein the concavity is closed by a cover lined with a layer of sound deadening material on its outer wall.

8. An internal combustion engine according to claim 6, wherein said auxiliary appliance is a starter motor.

* * * * *

UNITED STATES PATENT AND TRADEMARK OFFICE

CERTIFICATE OF CORRECTION

PATENT NO. : 4 077 383

DATED : March 7, 1978

INVENTOR(S) : Ernst Hatz

It is certified that error appears in the above-identified patent and that said Letters Patent are hereby corrected as shown below:

Column 6, line 44; change "6" to ---7---.

Signed and Sealed this

*Eighth* Day of *August 1978*

[SEAL]

*Attest:*

RUTH C. MASON
*Attesting Officer*

DONALD W. BANNER
*Commissioner of Patents and Trademarks*